United States Patent [19]

Nelson

[11] Patent Number: 4,974,627

[45] Date of Patent: Dec. 4, 1990

[54] GARDEN HOSE REEL CADDY

[75] Inventor: Terry N. Nelson, Shoreview, Minn.

[73] Assignee: The Specialty Mfg. Co., St. Paul, Minn.

[21] Appl. No.: 393,137

[22] Filed: Aug. 11, 1989

[51] Int. Cl.[5] ..... B65H 75/34

[52] U.S. Cl. ..... 137/355.27; 137/355.2; 242/86.2

[58] Field of Search ..... 137/355.16, 355.2, 355.26, 137/355.27; 248/76, 86.2, 86.5

[56] References Cited

U.S. PATENT DOCUMENTS

| | | | |
|---|---|---|---|
| D. 294,456 | 3/1988 | Nelson | D8/359 |
| 1,058,538 | 4/1913 | Boss | 137/355.12 |
| 1,115,325 | 10/1914 | McCall | 242/86.2 |
| 1,255,854 | 2/1918 | Boss | 137/355.12 |
| 1,537,637 | 5/1925 | Jarvis | 137/355.2 |
| 2,488,425 | 11/1949 | Morrone | 242/86.2 |
| 2,512,756 | 6/1950 | Wasserman | 242/86.2 |
| 3,587,626 | 6/1971 | Cowley | 137/355.12 |
| 4,137,939 | 2/1979 | Chow | 137/355.27 |
| 4,512,361 | 4/1985 | Tisbo et al. | 137/355.27 |
| 4,700,737 | 10/1987 | Nelson | 137/355.27 |
| 4,777,976 | 10/1988 | Johnston et al. | 137/355.27 |

FOREIGN PATENT DOCUMENTS

| | | |
|---|---|---|
| 249271 | 1/1964 | Austria . |
| 918237 | 9/1954 | Fed. Rep. of Germany . |
| 8111648 | 12/1982 | France . |
| 519498 | 3/1940 | United Kingdom . |

*Primary Examiner*—A. Michael Chambers

*Attorney, Agent, or Firm*—Dorsey & Whitney

[57] ABSTRACT

An improved garden hose reel caddy includes a lightweight, synthetic resin frame, a pair of front mounted transport wheels that are placed in noncontacting relationship with the ground when the caddy is at rest, a windable hose reel, an elevated hand crank for manually rotating the hose reel, and a gear drive mechanism coupling the hand crank to the hose reel. The hose reel is rotatably mounted on the support frame only a few inches above the ground so as to provide the hose reel caddy with a low center of gravity, while the gear drive mechanism enables placement of the hand crank at an elevated position to allow a user to rotate the hose reel without stooping to the ground level.

10 Claims, 1 Drawing Sheet

GARDEN HOSE REEL CADDY

TECHNICAL FIELD

This invention pertains to lawn care devices. In particular, it pertains to an improved, lightweight garden hose reel caddy having front mounted wheels and a low center of gravity to provide the caddy with inherent stability.

BACKGROUND ART

Windable reels for compactly storing flexible garden hose are well known. A hose reel that is supported on a portable caddy is disclosed in U.S. Pat. No. 1,255,854 to William Boss. A combination wall mount, caddy mount garden hose reel is disclosed in U.S. Pat. No. 4,700,737 to Terry Nelson. Other variations of garden hose reel caddies are disclosed in U.S. Pat. Nos. 3,587,626, 4,137,939, and 4,512,361.

Prior art hose reel caddies have, for the most part, proven to be satisfactory, lightweight, portable storage mechanisms for garden hoses. Conventional garden hose reel caddies, however, are prone to tipping over and traveling along the ground when garden hose is retracted from the hose reel. A portable, lightweight garden hose reel that resisted traveling and tipping over when garden hose was retracted from the reel would be a decided advantage.

SUMMARY OF THE INVENTION

The improved garden hose reel caddy in accordance with the present invention solves the problems of caddy travel and instability referred to above. The garden hose reel caddy hereof includes a lightweight, synthetic resin frame, a pair of front mounted transport wheels that are placed in noncontacting relationship with the ground when the caddy is at rest, a windable hose reel, and an elevated hand crank for manually rotating the hose reel. A gear drive assembly couples the hand crank to the hose reel such that the hand crank is easily accessible to the user of the caddy while, at the same time, the hose reel is located as low as possible to the ground for providing the caddy with a low center of gravity and inherent stability.

The unique construction of the garden hose reel caddy in accordance with the present invention provides several advantages. First of all, the hose reel caddy can be stored flush against a wall facing outwardly for ease of retraction of garden hose from the reel without moving the caddy. Alternatively, the caddy can be easily transported away from the wall by merely tipping the caddy forward onto its front mounted wheels. Secondly, because the caddy's front mounted wheels are elevated from engagement with the ground when the caddy is at rest, hose can be removed from the reel without the tendency of the caddy to travel forward in the direction of hose retraction. Thirdly, the low center of gravity of the hose reel provides for inherent stability of the caddy, while the spaced apart hand crank allows the user to rewind garden hose onto the reel without stooping down to ground level.

DETAILED DESCRIPTION OF THE DRAWINGS

Figure 1:
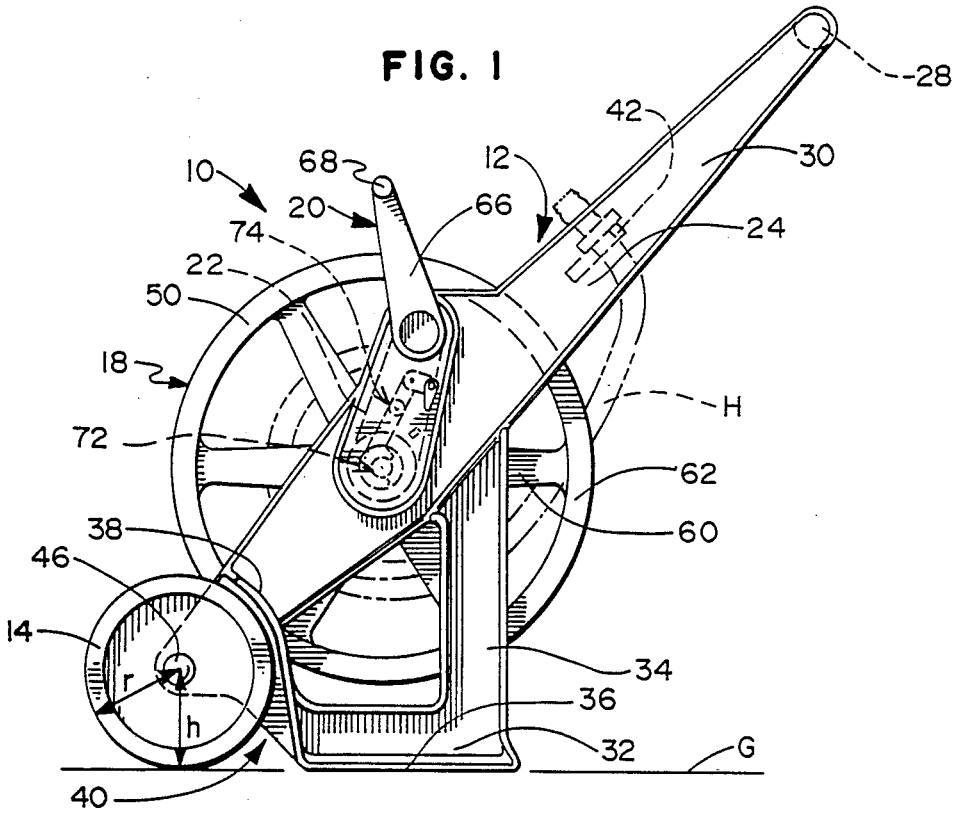
FIG. 1 is a left side elevational view of a garden hose reel caddy in accordance with the present invention.

The garden hose reel caddy 10 in accordance with the present invention broadly includes a preferably synthetic resin support frame 12, a pair of opposed transport wheels 14, 16, a hose reel 18 rotatably carried by the support frame 12, a hand crank 20, and a gear drive mechanism 22 coupling the hand crank 20 to the hose reel 18. The caddy 10 is depicted as resting on the ground G. A length of hose H is depicted in phantom lines coiled around the hose reel 18.

Support frame 12 includes generally parallel, spaced apart, left and right side frames 24, 26. Cross bar handle 28 extends between the side frames 24, 26. Each side frame 24, 26 is an intregally molded piece including diagonal member 30, generally horizontal stand base 32, and upright support leg 34. The support leg 34 extends upwardly from the stand base 32 to the diagonal member 30. Each stand base 32 includes an outwardly extending base flange 36. A fender 38 extends upwardly and forwardly from the base flange 36 to provide each side frame 24, 26 with a wheel well 40. Generally horizontal support member 42 extends between diagonal members 30 of each side frame 24, 26. The horizontal member 42 includes hose receiving notch 44 and may be either fixedly mounted or pivotally mounted to the diagonal members 30.

Transport wheels 14 are rotatably coupled to the support frame 12, and are received within wheel wells 40. As is best seen in FIG. 1, the axle 46 of each wheel 14 is positioned at a height h that is greater than the wheel radius r such that the wheels 14 are elevated in spaced apart relationship with the ground G when the caddy 10 is at rest.

Hose reel 18 is rotatably supported by the right and left side frames 24, 26 about axis of rotation 47. The hose reel 18 includes hose support surface 48, opposed reel sides 50, 52, outlet tube 54 for watertight connection with flexible hose H, and rotatable coupling 56 for watertight connection with water inlet tube 58. Reel sides 50, 52 each include support spokes 60 and outer reel rim 62.

Figure 2:
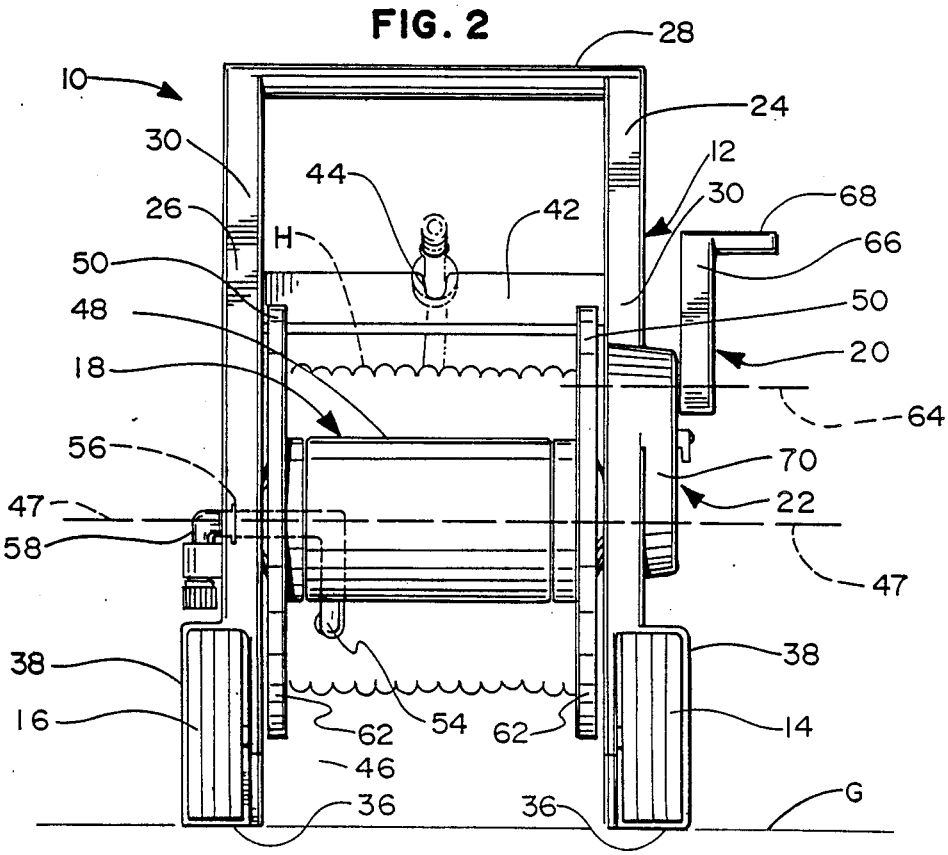
FIG. 2 is a front elevational view of the garden hose reel caddy depicted in FIG. 1.

Referring to FIG. 1, hose reel axis of rotation 47 is located rearwardly of transport wheels 14. More precisely, the axis of rotation 47 is rearwardly of the midpoint between upright leg 34 and transport wheel axle 46. As can be seen in both FIG. 1 and FIG. 2, the hose reel axis of rotation 47 is positioned on the side frames 24, 26 such that the wheel rims 62 of the hose reel 18 are located below the upper edge of transport wheels 14. Referring to FIG. 2, it will be seen that the hose reel rims 62 are generally even with the transport wheel axles 46.

Hand crank 20 is rotatably coupled to left side frame 24 about axis of rotation 64. The hand crank 20 includes lever arm 66 and handle 68. The hand crank axis of rotation 64 is located above and slightly rearwardly of the hose reel axis of rotation 47.

Gear drive mechanism 22 is located within drive housing 70. The drive mechanism 22 may comprise a sprocket and chain assembly 72 and freewheeling clutch mechanism 74 as depicted in phantom lines in FIG. 1, or may comprise any other suitable drive arrangement. A gear ratio between hand crank 20 and the hose reel 18 of approximately 1.5:1 may be provided to allow for ease of rewinding hose H onto hose reel 18.

In operation, the garden hose reel caddy 10 rests on base flanges 36 of support frame stand bases 32. Transport wheels 14 are lifted above the ground G when the caddy 10 is in its rest position, since the height h of the transport wheel axle 46 is greater than the radius r of the transport wheels 14. The garden hose reel caddy 10 will accordingly resist traveling in the direction of hose retraction as the hose H is retracted from the hose reel 18. As will be appreciated, the hose H is removed from the hose reel 18 by simply grasping the leading end of the hose H and pulling the hose in the direction desired.

The garden hose reel caddy 10 will resist tipping over while the hose H is being retracted from the reel 18, due to the low center of gravity of the caddy. In particular, the axis of rotation 47 of the hose reel 18, and therefore the center of gravity of the hose reel 18 and wound hose H, is positioned on the support frame 12 such that the wheel rims 62 of the reel sides 50, 52 are located only a few inches off the ground G. Notwithstanding the low position of the hose reel 18 on the caddy 10, the hose H is easily rewound onto the reel 18, without the user having to stoop to ground level, since the drive mechanism 22 allows the axis of rotation 64 of the hand crank 20 to be located well above the axis of rotation 47 of the hose reel 18. The presence of the flange 36 on stand base 32 also assists in the rewind operation, since the user may advantageously place his or her foot upon the base flange 36 to further support the garden hose reel caddy 10. The hose reel caddy is easily transported by tipping the support frame forwardly to engage the transport wheels 14 with the ground.

I claim:

1. A portable garden hose reel caddy, comprising:

a support frame including a ground engaging base member for supporting said support frame in a generally vertical rest position;

a hose reel rotatably carried by said frame about a hose reel axis of rotation; and transport wheels having a wheel base extending therebetween, each wheel defining a transport wheel radius, rotatably coupled to said frame about transport wheel axles, said wheel axles positioned at a height above said base member greater than said wheel radius such that said transport wheels are in noncontacting relationship with the ground when said reel caddy is in said rest position and wherein said ground engaging base member is in close proximity to said wheels and extends laterally outwardly beyond said wheel base.

2. The invention as claimed in claim 1, said caddy including a handle means operably coupled to said support frame rearwardly of said hose reel, said transport wheels being positioned forwardly of said hose reel.

3. The invention as claimed in claim 2, said support frame including a pair of opposed side frames, each side frame including a diagonal member extending rearwardly and upwardly from said transport wheels.

4. The invention as claimed in claim 3, said base member extending rearwardly of said transport wheels, said support frame including a generally upright member extending upwardly from said base member, said hose reel axis of rotation positioned generally between said transport wheels and said upright member.

5. The invention as claimed in claim 2, wherein said base member is positioned between said transport wheels and said handle means, substantially beneath said hose reel.

6. A portable garden hose reel caddy, comprising:

a support frame including a support frame base;

a hose reel rotatably carried by said support frame about a hose reel axis of rotation;

a hand crank rotatably carried by said support frame about a hand crank axis of rotation, said hand crank axis of rotation being spaced vertically and horizontally from said hose reel axis of rotation;

means drivingly coupling said hand crank to said hose reel whereby said hose reel can be positioned in close proximity to said support frame base to provide said hose reel with a low center of gravity and said hand crank can be positioned at an elevated orientation above said hose reel axis of rotation for ease of winding of said hose reel; and at least one ground engaging base member attached to said support frame, said at least one base member including a ground engaging foot surface extending generally transversely to said hose reel axis of rotation and said hand crank axis of rotation and extending substantially therebetween.

7. The invention as claimed in claim 6, including transport wheels, each wheel defining a transport wheel radius, rotatably coupled to said frame about transport wheel axles, said wheel axles positioned at a height above said support frame base greater than said wheel radius such that said transport wheels are in noncontacting relationship with the ground when said reel caddy is at rest.

8. The invention as claimed in claim 7, said caddy including a handle means operably coupled to said support frame rearwardly of said hose reel, said transport wheels being positioned forwardly of said hose reel.

9. The invention as claimed in claim 8, said support frame including a pair of opposed side frames, each side frame including a diagonal member extending rearwardly and upwardly from said transport wheels.

10. The invention as claimed in claim 9, said support frame base extending rearwardly of said transport wheels, said support frame including a generally upright member extending upwardly from said support frame base, said hose reel axis of rotation positioned generally between said transport wheels and said upright member.

* * * * *